US005483273A

United States Patent [19]

Fujimoto et al.

[11] Patent Number: 5,483,273

[45] Date of Patent: Jan. 9, 1996

[54] DRIVE CONTROL APPARATUS FOR THERMAL HEAD

[75] Inventors: Hisayoshi Fujimoto; Masatoshi Nakanishi; Kunio Motoyama, all of Kyoto, Japan

[73] Assignee: Rohm Co., Ltd., Kyoto, Japan

[21] Appl. No.: 365,163

[22] Filed: Dec. 28, 1994

Related U.S. Application Data

[63] Continuation of Ser. No. 168,401, Dec. 17, 1993, abandoned, which is a continuation of Ser. No. 836,808, Feb. 19, 1992, abandoned.

[30] Foreign Application Priority Data

| | | | |
|---|---|---|---|
| Feb. 26, 1991 | [JP] | Japan | 3-030978 |
| Mar. 6, 1991 | [JP] | Japan | 3-039952 |
| Apr. 3, 1991 | [JP] | Japan | 3-070993 |

[51] Int. Cl.[6] ..... B41J 2/36

[52] U.S. Cl. ..... 347/195

[58] Field of Search ..... 347/195, 188, 347/5, 9; 400/120.15, 120.09

[56] References Cited

U.S. PATENT DOCUMENTS

| | | | |
|---|---|---|---|
| 4,524,368 | 6/1985 | Inui et al. | 346/76 PH |
| 4,563,691 | 1/1986 | Noguchi et al. | 346/76 PH |
| 4,567,488 | 1/1986 | Moriguchi et al. | 346/76 PH |
| 4,663,734 | 5/1987 | Berry | 346/76 PH |
| 4,685,069 | 8/1987 | Inui et al. | 346/76 PH |
| 4,878,065 | 10/1989 | Fukushima et al. | 346/76 PH |
| 4,912,485 | 3/1990 | Minowa | 346/76 PH |

FOREIGN PATENT DOCUMENTS

| | | | |
|---|---|---|---|
| 0304916A1 | 1/1989 | European Pat. Off. . | |
| 0215376 | 12/1983 | Japan | 346/76 PH |
| 0116555 | 6/1986 | Japan | 346/76 PH |
| 0262158 | 10/1989 | Japan . | |

OTHER PUBLICATIONS

"*The Idea of Heat Accumulation Control*", The Sixth International Congress on Advances in Non–Impact Printing Technologies, Oct. 21, 1990–Oct. 26, 1990, The Society for Imaging Science and Technology, Springfield, Va., USA.

*Primary Examiner*—N. Le

*Attorney, Agent, or Firm*—Oliff & Berridge

[57] ABSTRACT

A drive control apparatus for a thermal head, capable of controlling application energy given to heater elements in the thermal head on the basis of not only history information of a present heater element but also print information including print history information of heater elements adjacent to the present heater element. A print information processing is carried out based on the print history information of the present heater element, the print information of the adjacent heater elements, and the print history information of the preceding and two times before print information of the adjacent heater elements. One example of this processing circuit includes an OR circuit for a logical sum of the preceding and two times before print information of the adjacent heater element, an AND circuit for a logical product of this OR output and a print speed signal, and an OR circuit for a logical sum of this AND output and the print information of the adjacent heater element.

20 Claims, 11 Drawing Sheets

ADJACENT DOT DATA
HISTORY DOT DATA
ADJACENT DOT DATA
46
47
44
45
ON/OFF
42
43
36
$S_I$
$S_F$
$S_C$
$S_G$
$S_D$
$S_A$
$S_H$
$S_E$
$S_B$

● PRINT HEATER ELEMENT ■ HEATER ELEMENT

DRIVE CONTROL APPARATUS FOR THERMAL HEAD

This is a Continuation of application Ser. No. 08/168,401 filed Dec. 17, 1993, now abandoned, which in turn is a Continuation of application No. 07/836,808 filed Feb. 19, 1992 now abandoned.

BACKGROUND OF THE INVENTION i) Field of the Invention

The present invention relates to a drive control apparatus for a thermal head and more particularly to an apparatus for a formation of a control signal for driving heater elements in the thermal head.

ii) Description of the Related Arts

Conventionally, a thermal head is provided with a heater element group or a plurality of heater elements arranged in a matrix form corresponding to print dots, and the heater elements are selectively driven according to print data in order to carry out a print operation directly onto heat sensitive paper or onto paper via an ink ribbon. In the thermal head of this kind, when the print speed is increased, the next driving operation of the heater elements is started before the temperature of the driven heater elements is lowered, and hence the surface temperature of the thermal head is raised to cause uneven printing. Further, when the heat storage temperature of the head is increased, the thermal stress causes cracks or bubbles in the head which reduces the head life. Accordingly, in the conventional thermal head, a past thermal history of the heater elements is detected, and a current application time to the heater elements is controlled according to the detected result.

In FIG. 1, there is shown a conventional drive control apparatus for a thermal head. In this drive control apparatus, print data are stored in a shift register (S.R.) 1 by using a clock signal. To the shift register 1, a plurality of gate circuits 3*a* to 3*n* are connected via a latch circuit 2, and the gate circuits 3*a* to 3*n* are coupled to respective heater elements 4. In this case, the print data stored in order in the shift register 1 are temporarily held in the latch circuit 2 and are then output to the gate circuits 3*a* to 3*n*. Hence, in the gate circuits 3*a* to 3*n*, on the basis of the present print data, the preceding print data and a gate signal, a print control signal to be fed to the heater elements 4 is formed. For example, when the print data are "Hi" (print state) at not only the present time but also the preceding time, a control signal of a shorter pulse is formed rather than in the case where the print data are "Hi" at the present time but "Low" (blank state) at the preceding time. As a result, a suitable current application time considering the past heat generation state is given, and a good printing operation can be carried out. Further, in this case, a history taking into account the state of the heater element two times before can be also considered.

In the above-described conventional drive control apparatus for the thermal head, as shown in FIG. 2, when a zigzag half pattern printing operation is carried out, a blank part is partially encroached by the printed part and a good quality printing state can not be sufficiently obtained.

Accordingly, it is considered that the drive time, the drive voltage and the like of the present heater element to be controlled are controlled with reference to not only the print history information of the present heater element but also to the print information of the adjacent heater elements in order to obtain proper printed dots.

However, particular in case of speed printing, since the history of the adjacent heater elements has an influence on the print quality, it is necessary to consider the print history information of the adjacent heater elements in addition to the print history information of the present heater element and the print information of the adjacent heater elements.

Hence, as shown in FIG. 3, it can be considered to drive a present heater element for printing a dot $D_A$ in consideration of not only the present states of dots $D_B$ and $D_C$ of the adjacent heater elements, and the preceding state of dot $D_D$ and a state two times before of dot $D_G$ of the present heater element but also the preceding state of dots $D_E$ and $D_F$ and the state two times before of dots $D_H$ and $D_I$ of the adjacent heater elements.

However, if these dots are all considered, the number of dot bits to be considered is 8, and, when a level separation is executed in consideration of all these particulars, there are 256 level separations. Thus, the circuit structure becomes very complicated, and further it is actually impossible to carry out a rapid transmission of 256 level data to a driver.

SUMMARY OF THE INVENTION

It is therefore an object of the present invention to provide a drive control apparatus for a thermal head in view of the aforementioned problems, which is capable of controlling application energy for the thermal head according to not only print history information of present heater element to be driven but also print information including print history information of adjacent heater elements, reducing the number of bits of print information to be considered in such a controlling operation, and carrying out high speed processing without necessitating a complicated circuit structure.

In accordance with one aspect of the present invention, there is provided a drive control apparatus for a thermal head for carrying out drive control on the basis of print information of a plurality aligned heater elements, comprising processor means for processing print information on the basis of history information of a present heater element to be driven, print information of heater elements adjacent to the present heater element, and history information of preceding and two times before print information of the adjacent heater elements; and controller means for controlling application energy of the present heater element according to the print information processed by the processor means.

In a preferred embodiment, the apparatus further comprises memory cells for storing print information of the heater elements.

In another preferred embodiment, the apparatus further comprises a first shift register for storing present print information of the heater elements; a second shift register for storing preceding time print history information of the heater elements; a third shift register for storing two times before print history information of the heater elements; and a history processor to which is input the print history information of the present heater element to be processed and the print information and the history print information of the adjacent heater elements from the first, second and third shift registers and carrying out a history processing of the present heater element on the basis of the input information.

The history processor can include an OR circuit for outputting an OR output of the present time print information of the adjacent heater element and the preceding and two times before print information of the adjacent heater element to process it as the print information of the adjacent heater element.

The history processor can also include a switch part for carrying out an ON and OFF operation of the preceding and two times before print information of the adjacent heater element.

The history processor can further include an AND circuit for outputting an AND output of an OR output of the preceding time print information and the two times before print information of the adjacent heater element and a printing speed signal, and an OR circuit for outputting an OR output of the AND output of the AND circuit and the present time print information of the adjacent heater element to process the print information of the adjacent heater element.

The history processor can still further include an OR circuit for outputting an OR output of the preceding time print history information and the two times before print history information of the present heater element to process the print history information of the present heater element.

The history processor can control current supply time in a priority order of the preceding time print history information of the present heater element, the two times before print history information of the present heater element, and the print information of the adjacent heater elements.

Further, in case that the level separation of the current supply time is conducted into the priority order of the preceding history print information of the present heater element, the two times before history print information of the present heater element and the print information of the adjacent heater elements, when it is discriminated that the current supply times of these print information are equal, by using an increment function (INC), the level separation can be reduced, and thus a more high speed processing can be carried out.

BRIEF DESCRIPTION OF THE DRAWINGS

The above and other objects, features and advantages of the present invention will more fully appear from the following description of the preferred embodiments with reference to the accompanying drawings, in which.

DESCRIPTION OF THE PREFERRED EMBODIMENTS

Figure 1:
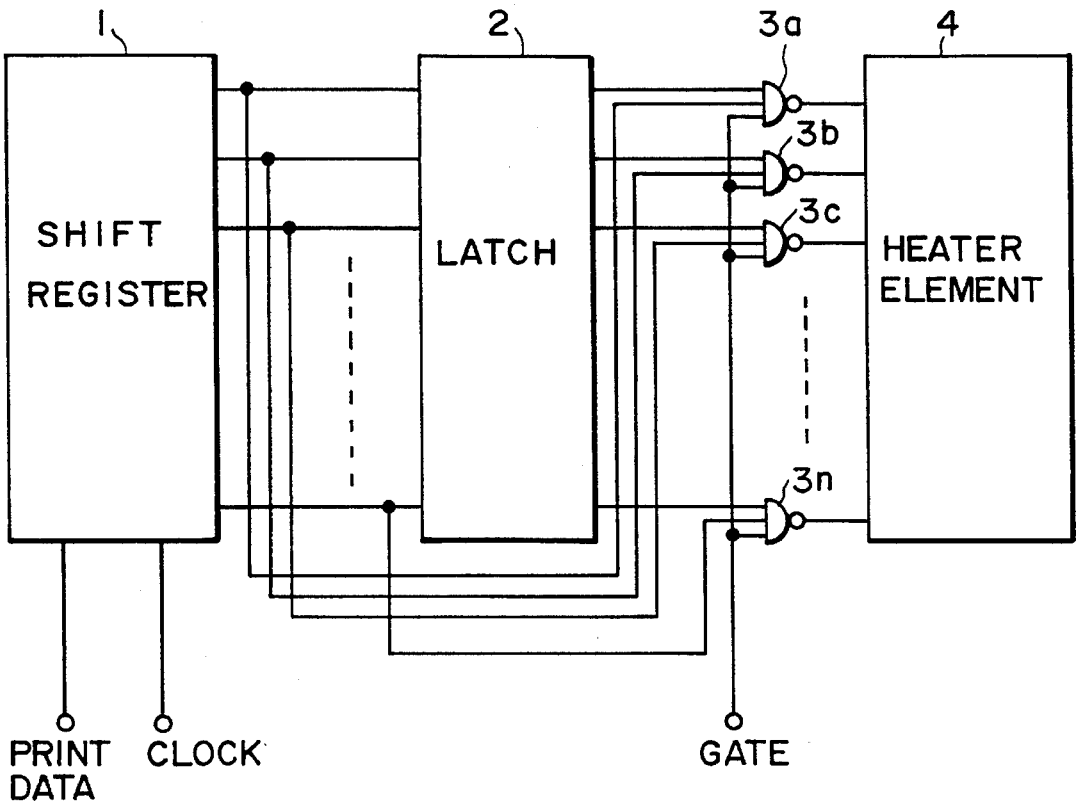
FIG. 1 PRIOR ART
FIG. 1 is a block diagram of a conventional drive control apparatus for a thermal head.
Figure 2:
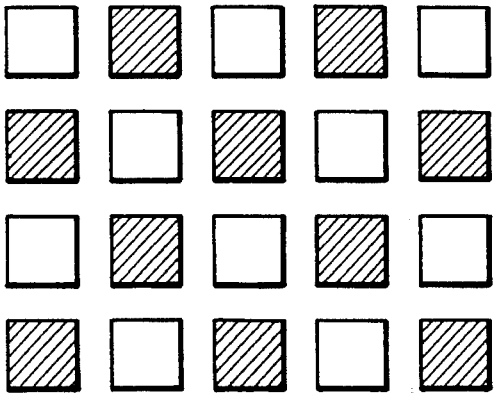
FIG. 2 PRIOR ART
FIG. 2 is an explanatory view schematically showing a print example of a zigzag half pattern used in the apparatus shown in FIG. 1
Figure 3:
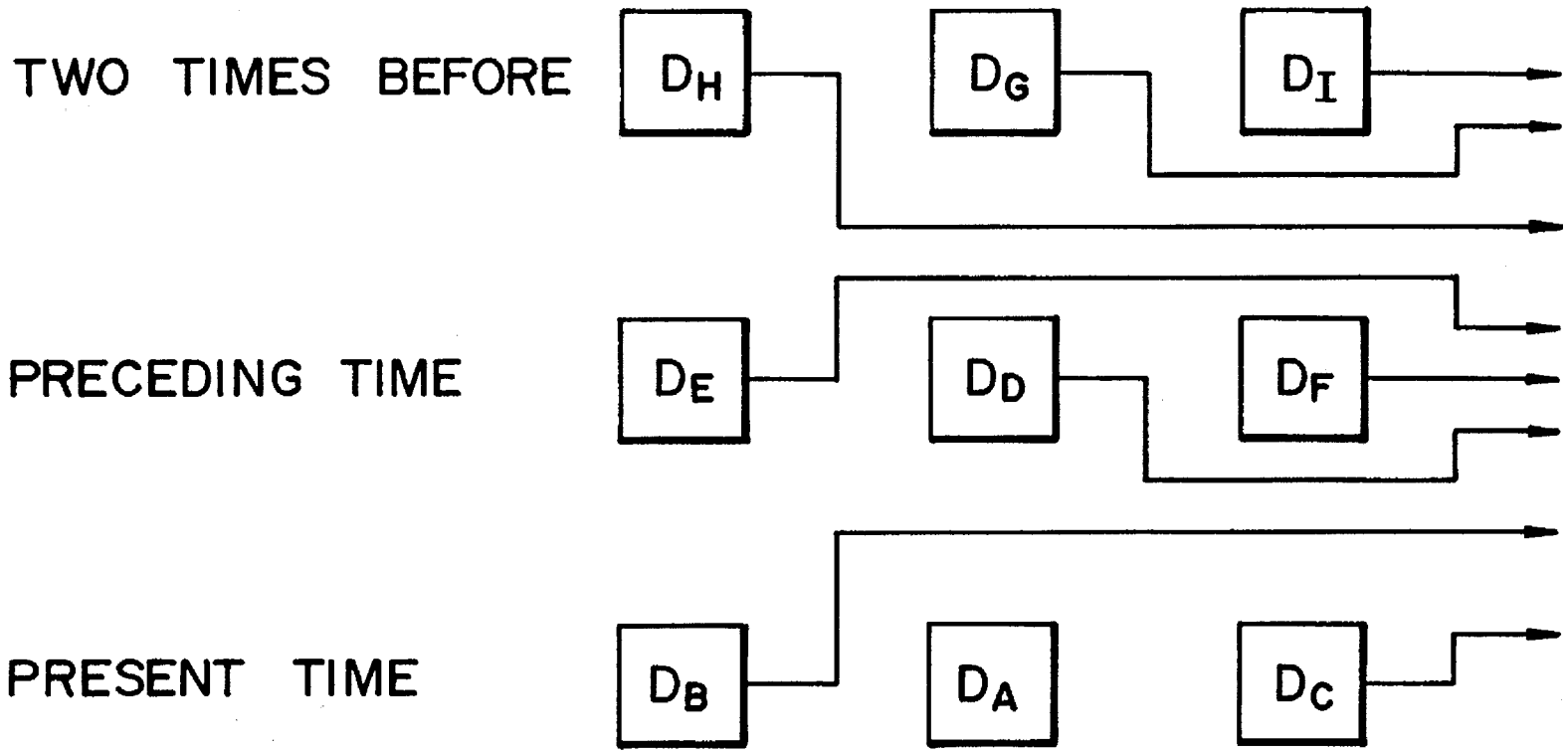
FIG. 3 PRIOR ART
FIG. 3 is an explanatory view schematically showing print dots arranged in a matrix form to be considered during history processing in the apparatus shown in FIG. 1.

The present invention will now be described in connection with its preferred embodiments with reference to the attached drawings, wherein like reference characters designate like or corresponding parts throughout the views and thus the repeated description thereof can be omitted for brevity.

Figure 4:
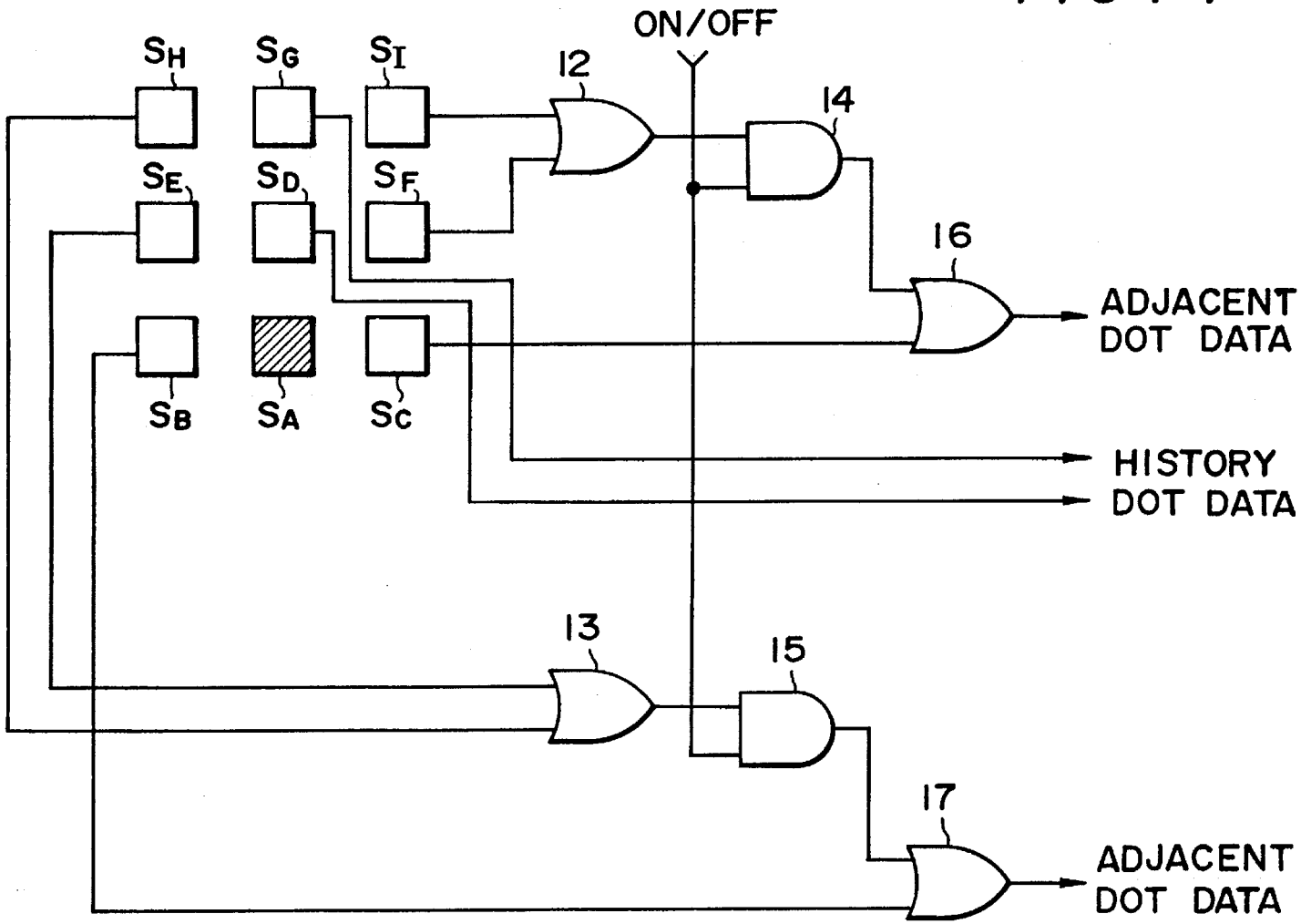
FIG. 4 is a circuit diagram of one embodiment of a logic circuit for obtaining a control signal for controlling the application energy given to heater elements according to the present invention.

There is shown in FIG. 4 one embodiment of a logic circuit for obtaining a control signal for controlling the application energy given to heater elements in a thermal head according to the present invention. In this embodiment, there are provided memory cells $S_A$, $S_B$, $S_C$, $S_D$, $S_E$, $S_F$, $S_G$, $S_H$ and $S_I$ arranged in a 3×3 matrix form, that is, $S_A$ for storing print information for printing at the present time by a present heater element, $S_B$ and $S_C$ for storing print information for printing at the present time by heater elements adjacent to the present heater element, $S_D$ for storing print information for printing the preceding time by the present heater element, $S_G$ for storing print information for printing two times before by the present heater element, $S_E$ and $S_F$ for storing print information for printing the preceding time by the adjacent heater elements and $S_H$ and $S_I$ for storing print information for printing the two times before by the adjacent heater elements.

Although this embodiment is described with reference to the memory cell $S_A$ for storing the print information of the present heater element to be driven for printing at the present time, the processing of the print information of another heater element for printing at the present time can be carried out in the same manner as the cell $S_A$ by using the same logic circuit, and thus in this instance, the processing for one heater element will be described.

As shown in FIG. 4, the outputs of the memory cells $S_D$ and $S_G$ for storing the preceding print information and the two times before print information of the present heater element are output directly as history dot data of the present heater element. The outputs of the memory cells $S_F$ and $S_I$ for storing the preceding print information and the two times before print information of one adjacent heater element are input to two input terminals of an OR circuit 12, and the output of the OR circuit 12 is input to one input terminal of an AND circuit 14. The outputs of the memory cells $S_E$ and $S_H$ for storing the preceding print information and the two times before print information of the other adjacent heater element are input to input terminals of an OR circuit 13, and the output of the OR circuit 13 is input to one input terminal of an AND circuit 15. An ON/OFF signal for selecting whether or not the history print information of the adjacent elements is output as the control signal is input to the other input terminals of the AND circuits 14 and 15. The output of the AND circuit 14 is input to one input terminal of an OR circuit 16, and the output of the memory cell $S_C$ for storing the present print information of one adjacent heater element is input to the other input terminal of the OR circuit 16. The output of the OR circuit 16 is output as one adjacent dot data. The output of the AND circuit 15 is input to one input terminal of an OR circuit 17, and the output of the memory cell $S_B$ for storing the present print information of the other adjacent heater element is input to the other input terminal of the OR circuit 17. The output of the OR circuit 17 is output as the other adjacent dot data.

In this embodiment, when the thermal head is used for high speed printing, an ON signal as the ON/OFF signal is input to the AND circuits 14 and 15. As a result, the history dot data of the preceding time and two times before of the present heater element are output from the memory cells $S_D$ and $S_G$. The present print information and the preceding and two times before print history information of one adjacent heater element are output from the OR circuit 16, and the present print information and the preceding and two times before print history information of the other adjacent heater element are output from the OR circuit 17.

By the outputs of the OR circuits 16 and 17 and the history dot data of the preceding time and two times before of the present heater element, the print information of the adjacent heater elements, the print history information of the present heater element, the print history information of the adjacent heater elements are referred and output as the information for controlling the application energy given to the present heater element. Hence, since up to the print history information of the adjacent heater elements is considered, even during high speed printing, by carrying out a contraction drive control, a high quality printing can be performed.

On the other hand, when the thermal head is used for low speed printing, an OFF signal is fed to the AND circuits 14 and 15, and hence, the outputs of the OR circuits 12 and 13 are stopped at the AND circuits 14 and 15. Accordingly, only the print information of the adjacent heater elements is output from the OR circuits 16 and 17, and hence the control of the application energy to the present heater element is carried out according to the print information of the adjacent heater elements and the print history information of the present heater element so as to perform a concise print control.

Figure 5:
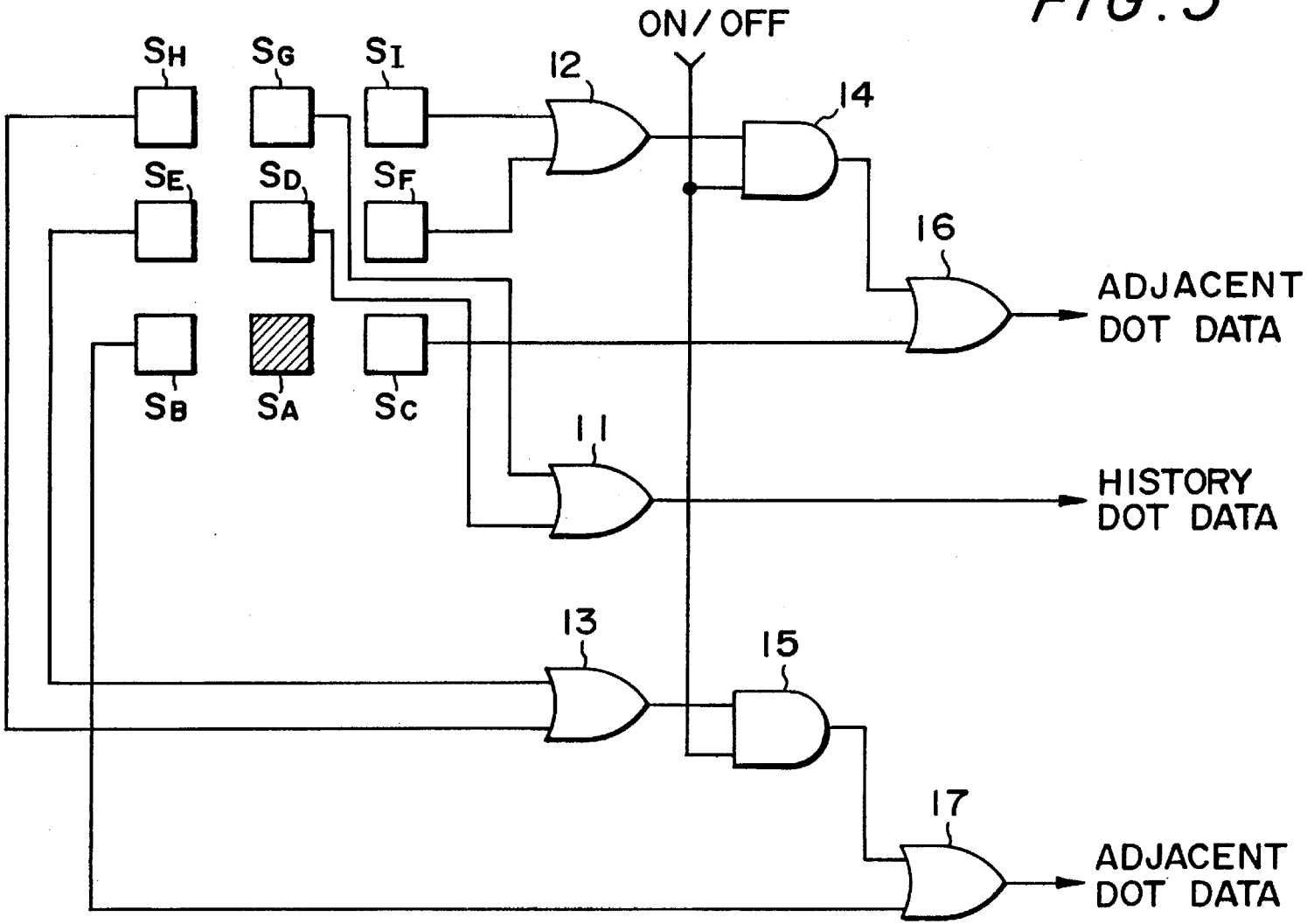
FIG. 5 is a circuit diagram of another embodiment of a logic circuit for obtaining a control signal for controlling the application energy given to heater elements according to the present invention.

In FIG. 5, there is shown another embodiment of a logic circuit for obtaining a control signal for controlling application energy given to heater elements in a thermal head according to the present invention, having the same construction as the first embodiment shown in FIG. 4, except that the outputs of the memory cells $S_D$ and $S_G$ are output as the history dot data of the present heater element through an OR circuit 11. In this embodiment, the same effects and advantages as those in the first embodiment shown in FIG. 4 can be obtained.

Figure 6:
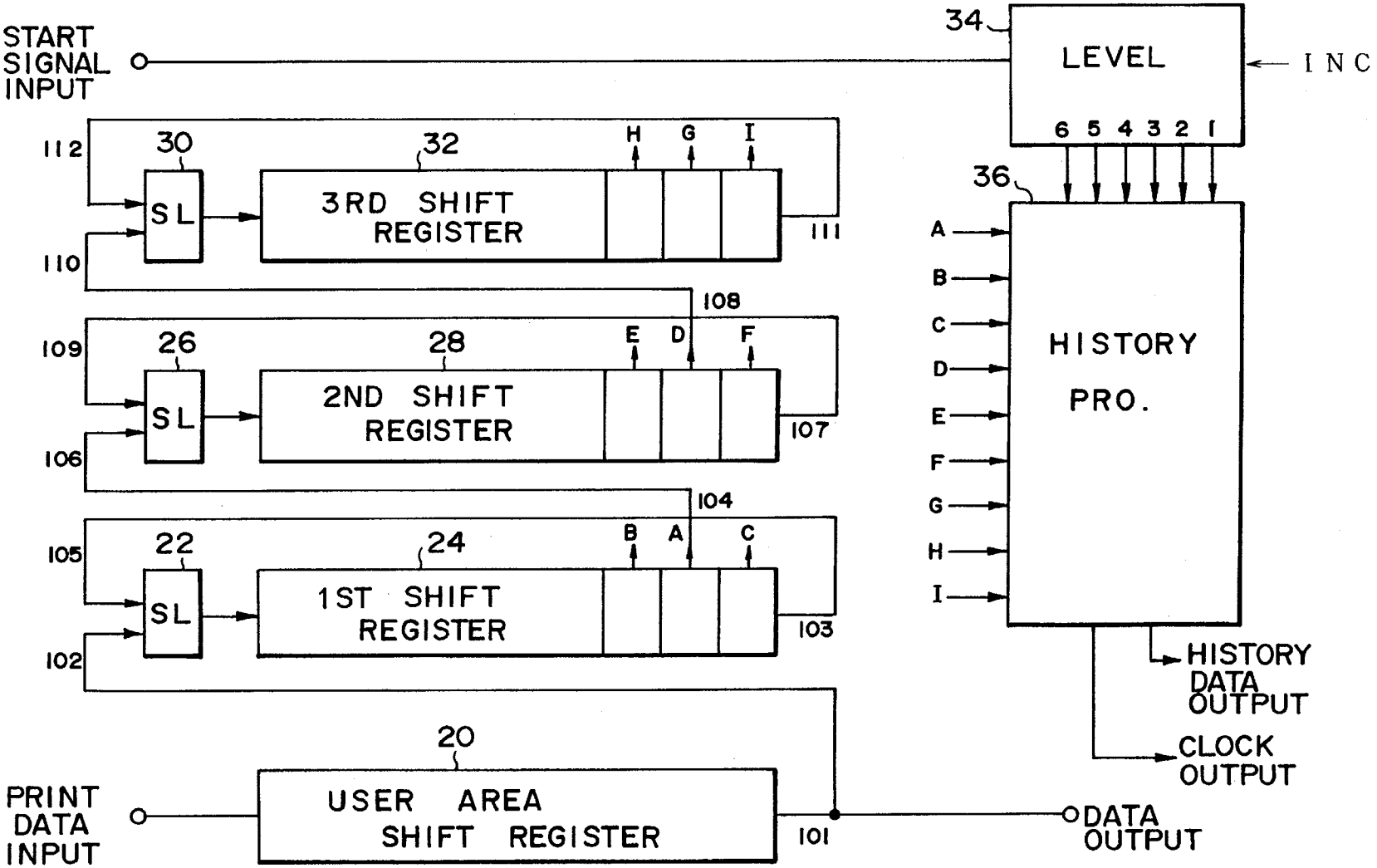
FIG. 6 is a block diagram of a drive control apparatus for a thermal head using shift registers according to the present invention.

In FIG. 6, there is shown one embodiment of a drive control apparatus for a thermal head according to the present invention. In this embodiment, a print data input terminal and a data output terminal are coupled to a user area shift register (S.R.) 20 for storing the print data in the user side, and a first shift register (S.R.) 24 for storing the print data at the present time is connected to the user area shift register 20 through a first selector (SL) 22. A second shift register (S.R.) 28 for storing the print data at the preceding time is coupled with the first shift register 24 through a second selector (SL) 26. A third shift register (S.R.) 32 for storing the print data two times before is coupled with the second shift register 28 through a third selector (SL) 30. In each of the first, second and third shift registers 24, 28 and 32, the print data stored therein are circulated in order through the selector 22, 26 or 30. A start signal input terminal is coupled to a level set 34, and a history processor 36 is connected to the level set 34. The print data A, B, C, D, E, F, G, H and I required for the history processing are output from output terminals of the first, second and third shift registers 24, 28 and 32 to the history processor 36, and the history processor 36 outputs history data and a clock signal.

Figure 7:
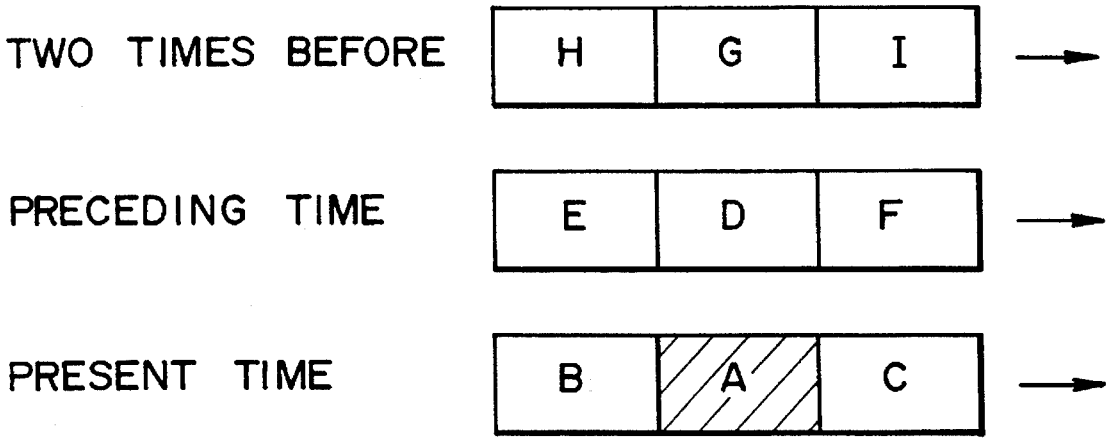
FIG. 7 is an explanatory view schematically showing print data required for print data processing in the apparatus shown in FIG. 6.

FIG. 7 shows a relationship between the print data A, B, C, D, E, F, G, H and I at the present time, the preceding time and two times before for the history processing and a present heater element and two adjacent heater elements thereto. That is, the (print dot) data of the present heater element to be processed are A and the print data of the adjacent heater elements at the present time are B and C. The print data of these three heater elements at the preceding time are D, E and F, and the print data of the three heater elements two times before are G, H and I. Hence, in this case, in order to obtain the print information of the data A, the data B to I are used. By converting the order of these information items by manipulation within the shift registers 24, 28 and 32, the history processing of all heater elements can be carried out.

Figure 8:
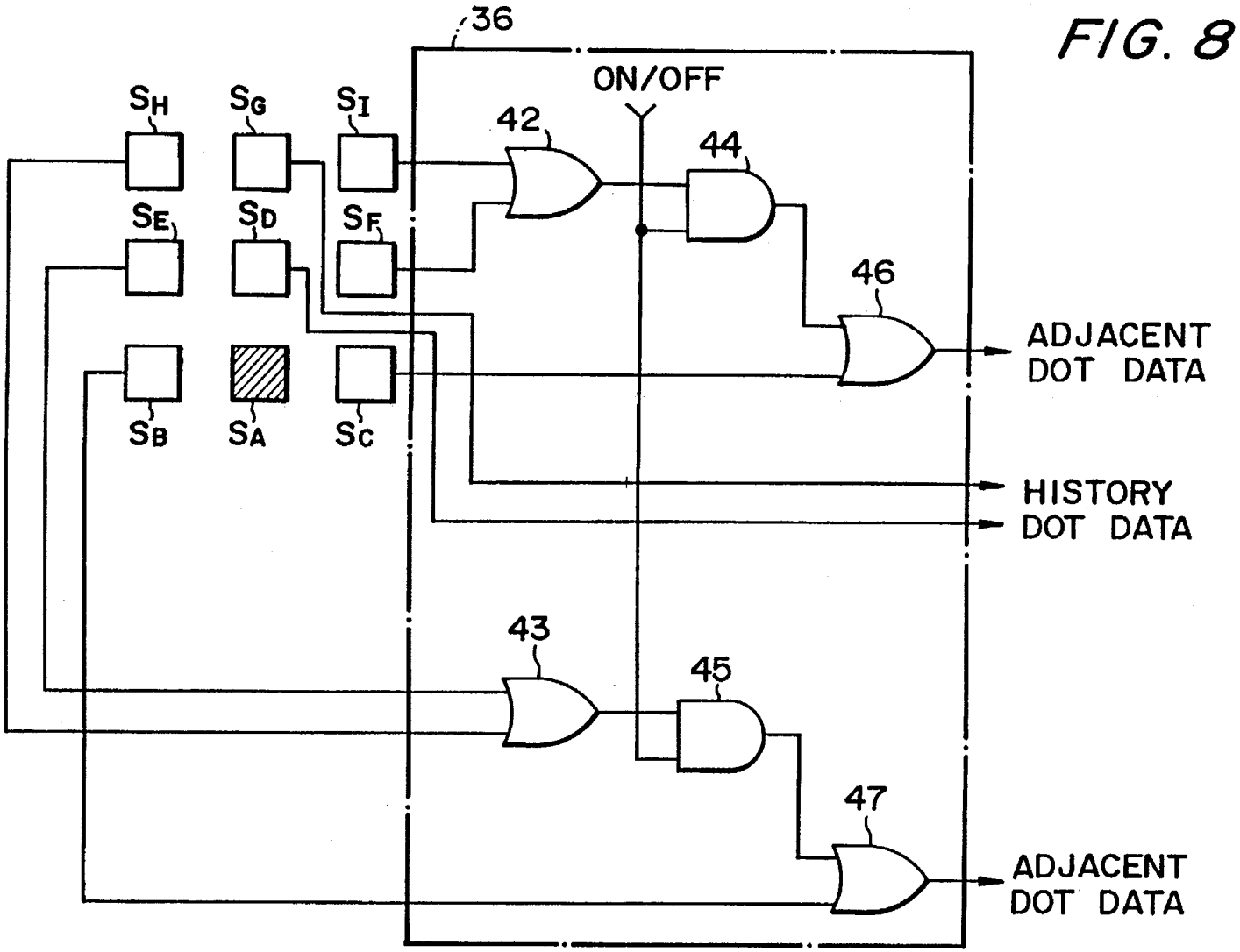
FIG. 8 is a circuit diagram of one embodiment of a history processor shown in FIG. 6.

In FIG. 8, there is shown one embodiment of the history processor 36 along with the memory cells $S_A$, $S_B$, $S_C$, $S_D$, $S_E$, $S_F$, $S_G$, $S_H$ and $S_I$ arranged in the 3×3 matrix form in the same manner as the embodiment shown in FIG. 4. The memory cells $S_A$, $S_B$, $S_C$, $S_D$, $S_E$, $S_F$, $S_G$, $S_H$ and $S_I$ corresponding to the print data A, B, C, D, E, F, G, H and I of the heater elements as shown in FIG. 7 are contained in the first, second and third shift registers 24, 28 and 32 shown in FIG. 6. That is, as shown in FIG. 8, the outputs of the memory cells $S_D$ and $S_G$ are directly output as the history dot data of the present heater element. The outputs of the memory cells $S_F$ and $S_I$ are input to an OR circuit 42 for calculating a logical sum thereof, and the output of the OR circuit 42 is input to one input terminal of an AND circuit 44. The outputs of the memory cells $S_E$ and $S_H$ are input to an OR circuit 43, and the output of the OR circuit 43 is input to one input terminal of an AND circuit 45. An ON/OFF signal for changing the control conditions according to either low speed printing or high speed printing is input as the control signal to the other input terminals of the AND circuits 44 and 45 for calculating a logical product of the two input data. The output of the AND circuit 44 is input to one input terminal of an OR circuit 46, and the output of the memory cell $S_C$ is input to the other input terminal of the OR circuit 46. The output of the OR circuit 46 is output as one adjacent dot data. The output of the AND circuit 45 is input to one input terminal of an OR circuit 47, and the output of the memory cell $S_B$ is input to the other input terminal of the OR circuit 47. The output of the OR circuit 47 is output as the other adjacent dot data.

Next, the operation of the drive control apparatus shown in FIG. 6 will be described in detail.

First, when electric power is turned on or a reset signal is input, the first, second and third shift registers 24, 28 and 32 are cleared, and the print data are input from a user to the user area shift register 20. When a load is input, the print data are consecutively sent from the user area shift register 20 to the first shift register 24 via the first selector 22 (101 to 102), from the first shift register 24 to the second shift register 28 via the second selector 26 (104 to 106), and from the second shift register 28 to the third shift register 32 via the third selector 30 (108 to 110). Hence, the first, second and third shift registers 24, 28 and 32 store the present print data, the preceding print data and the two times before print data, respectively.

Next, when a first start signal is input to the level set 34, a level 1 rises in the level set 34, and the data are circulated in the direction of 103 to 105, 107 to 109 and 111 to 112 in the respective first, second and third shift registers 24, 28 and 32. At the same time, the print data A to I are supplied to the history processor 36.

As shown in FIG. 8, the OR circuits 42 and 43 calculate the logical sums of the preceding and two times before print data of the adjacent heater elements. The outputs of the memory cells $S_G$ and $S_D$ are directly output as the history dot data. In turn, the logical product of the output of the OR circuit 42 and the ON/OFF signal for determining whether or not the history processing is carried out is calculated in the AND circuit 44, and the logical product of the output of the OR circuit 43 and the ON/OFF signal is calculated in the AND circuit 45. At this time, in the case of high speed printing, since the ON signal (Hi) is fed to the AND circuits 44 and 45, when the output of the OR circuit 42 or 43 is "Hi", the output of the AND circuit 44 or 45 becomes "Hi". Then, the logical product of the output of the AND circuit 44 and the print data of the memory cell $S_C$ is calculated in the OR circuit 46, and logical product of the output of the AND circuit 45 and the print data of the memory cell $S_B$ is calculated in the OR circuit 47. The OR circuits 46 and 47 output the adjacent dot data.

Therefore, the "Hi" or "Low" of the history information of the present heater element is directly output as the history dot data. In the OR circuit 46 or 47, when at least one of the three print data such as print data and the history print data of the adjacent heater elements is "Hi", the "Hi" of the adjacent dot data are output. After the history processing of level 1 is finished as described above, the start signal of the next level is input to the level set 34, and level 2 to level 6 stand up in order in the level set 34. Hence, the history processing is repeated as described above, and the history processor 36 outputs the history data for the present heater element together with the clock signal.

As described above, using 4 output bits from the history information and the OR circuits 46 and 47, the print information of the present heater element, the preceding and two times before history information of the present heater element, and the print information and the history information of the adjacent heater elements are represented respectively, and the application energy of the present heater element is controlled. In practice, the control of the application energy is carried out by controlling the current supply time, and the trailing edges of the current supply times are aligned so as to make the temperatures of the heater elements equal.

Figure 9:
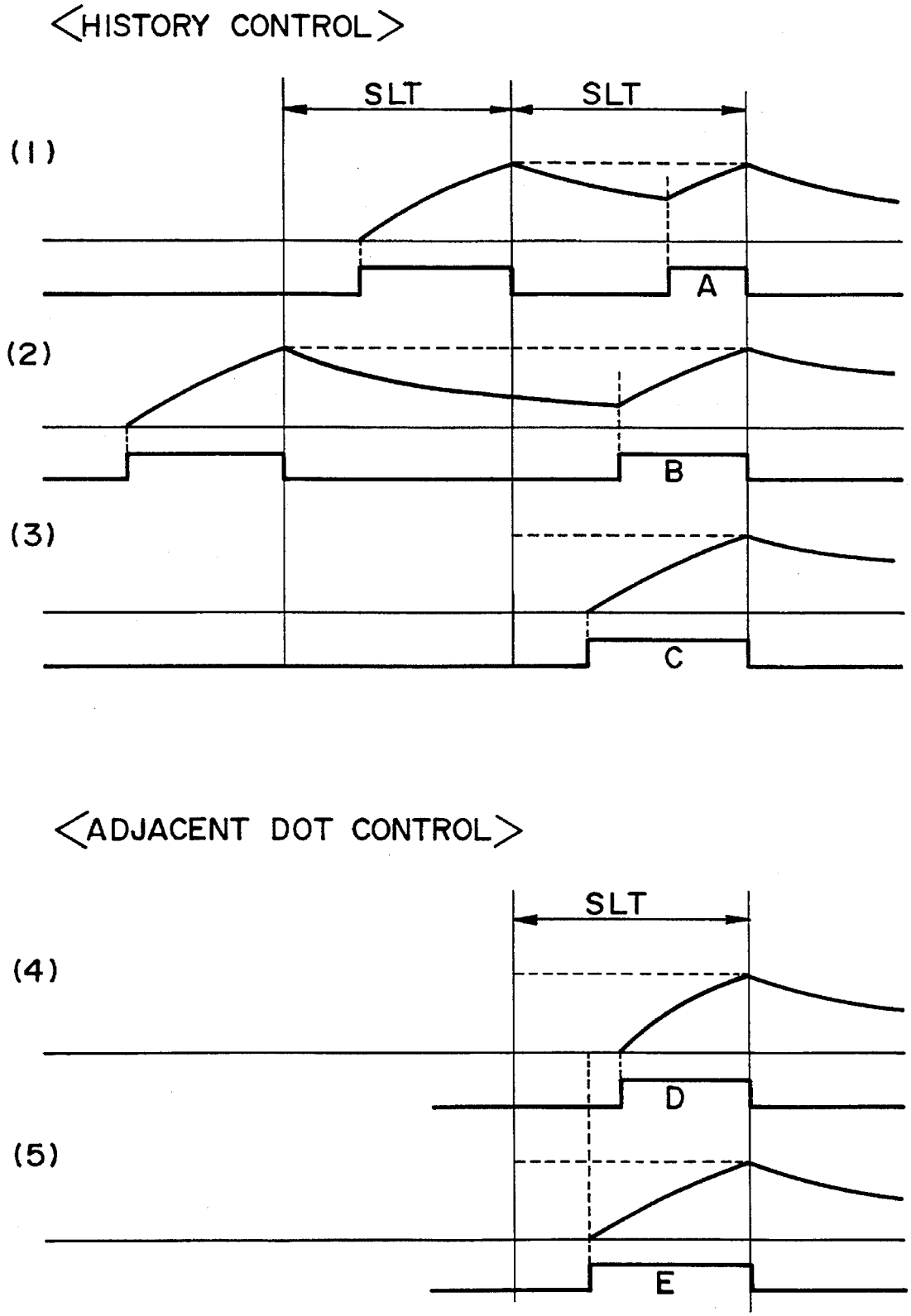
FIG. 9 is a timing chart for explaining the theory of history control and adjacent dot control used in the apparatus shown in FIG. 6.

Basically, as shown in FIG. 9, in the history control, when the present heater element is heated at the preceding time (1), since the thermal energy remains, a short current supply time is sufficient, when the present heater element is heated two times before (2), a longer current supply time than the preceding heating case is necessary, and when the present heater element is independently heated or not heated at the preceding time nor two times before (3), a still longer current supply time than the two times before heating case is required. In turn, in the adjacent dot control, when both the adjacent dots are heated at the same time (4), since the heat is not released sideways, the leading inclination of heat becomes large, and the temperature reaches the peak in a short time. Hence, a short current supply time is sufficient. When the present heater element is independently heated without heating the adjacent dots (5), the same result as the above case (3) is obtained.

Figure 10:
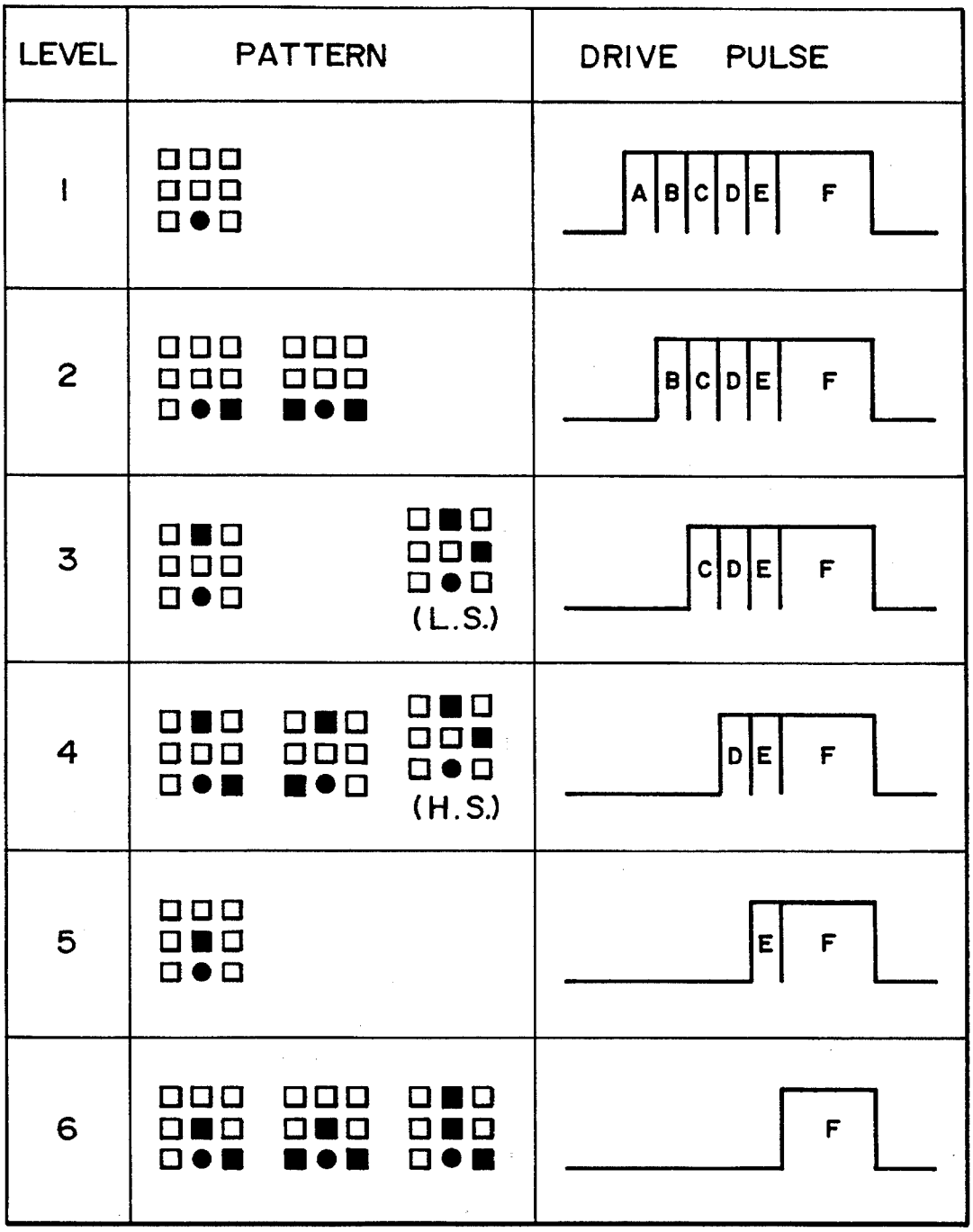
FIG. 10 is an explanatory view showing drive pulse forms along with heater element patterns, formed in the apparatus shown in FIG. 6.

In practice, as shown in FIG. 10, by a combination of the outputs of 4 bits, the drive pulses are separated into 6 different durations for control purposes. That is, the current supply times of A to F are determined. When the history dot data and the adjacent dot data are "Low", a drive pulse of the maximum time length (A through F) as shown in level 1 is formed. When the adjacent dot data are "Hi" (heating condition), a drive pulse composed of time B through F as shown in level 2 is formed. When the two times before dot data are "Hi" or the like, a drive pulse composed of time C through F as shown in level 3 is formed. When the two times before dot data and the adjacent dot data are "Hi", a drive pulse composed of time D through F in level 4 is formed. When the preceding time dot data are "Hi", a drive pulse composed of time E and F in level 5 is formed. When the preceding time dot data and the adjacent dot data are "Hi", a drive pulse composed of time F in level 6 is formed. Hence, on the basis of the heating conditions of the heater elements except the present heater element, the above-described drive pulses are formed and given to the present heater element.

Further, as to the history information of the adjacent heater elements, for example, as shown in level 3, in the case of low speed printing (L.S.) (OFF state), when the preceding time adjacent dot data are "Hi", no history information can be considered, but as shown in level 4, in the case of high speed printing (H.S.) (ON state), if the preceding time adjacent dot data are "Hi", the short time drive pulse composed of time D through F is formed.

Figure 11:
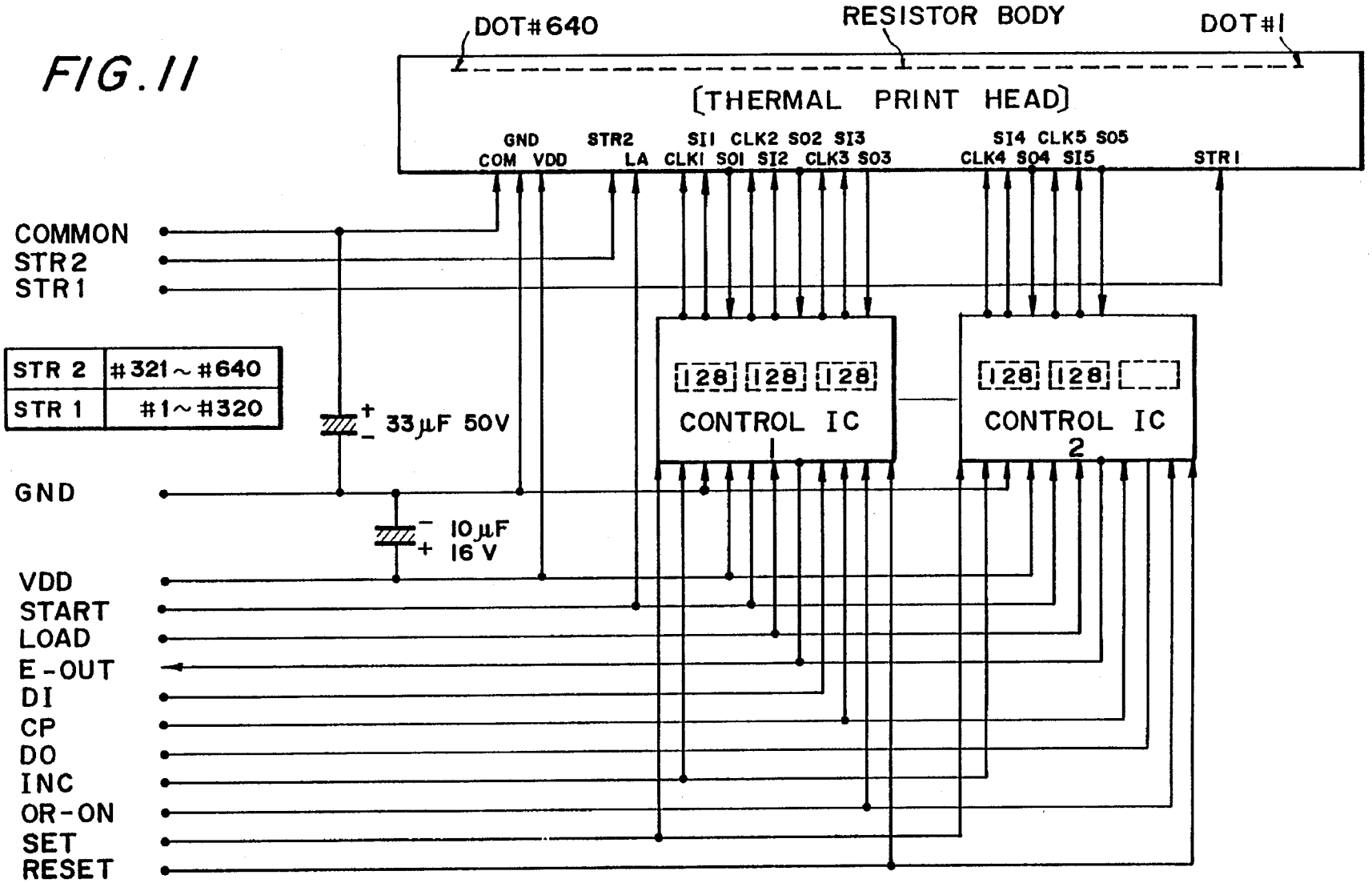
FIG. 11 is an explanatory view of a variety of signals to be input to a print head according to the present invention.

In this embodiment, as shown in FIG. 11, the data output from the user area shift register 20, the history data output from the history processor 36 and the like shown in FIG. 6 are input into "CONTROL ICs", and the current supply control of the heater elements in the print head is carried out. This print head is of a 640 dot type, as shown in FIG. 11. In FIG. 11, "DI" indicates the data input, and the history data are input to "START". "VDD" designates a supplied power voltage, and a "LOAD" signal acts for inputting the print data into the CONTROL ICs and holding the same. An "E-OUT" signal is output when a transmission error of the print data is caused. A "CP" signal corresponds to the clock output from the history processor 36 shown in FIG. 6. "DO" indicates "DATA OUT", from which the print data are output. A "SET" signal acts to change all the print data in the "CONTROL ICs" to "1", and a "RESET" signal acts to change all print data in the "CONTROL ICs" to "0".

Since, the print head is of the 640 dot type, the shift registers 20, 24, 28 and 32 can correspond to 640 dots.

Further, in FIG. 11, "OR-ON" is a signal for determining whether the history data of the adjacent heater elements are made valid or not. In this embodiment, when the ON/OFF signal is input it has the same function as the "OR-ON", and thus no "OR-ON" is input.

According to the history processor 36 comprising the logic circuits shown in FIG. 8, a high speed operation can be performed and it is possible to carry out the history processing at a speed of several nsec/bit. Further, the history information of the adjacent heater elements are also considered, and thus even during high speed printing, duels the contraction drive control, high quality printing can be performed. The print data used for the history processing are circulated in the shift registers 24, 28 and 32, and the history processing is carried out in the history processor 36 in synchronism with the print data circulation. Hence, the circuit can be composed of an extremely small number of gates. That is, when the history processing is conducted in the conventional apparatus shown in FIG. 1, a large number of gate circuits must be combined. Hence, the structure becomes complicated, and, when the circuits are formed as IC circuits, the chip size is enlarged with a resultant cost increase.

Further, when the thermal head is used for low speed printing, the OFF signal is supplied to the AND circuits 44 and 45. Hence, the outputs of the OR circuits 42 and 43 are stopped by the AND circuits 44 and 45, and only the print data of the adjacent heater elements are output from the OR circuits 46 and 47. In this instance, the application energy control of the present heater element is carried out according to the print data of the adjacent heater elements and the history print information of the present heater element to enable the concise printing control.

Figure 12:
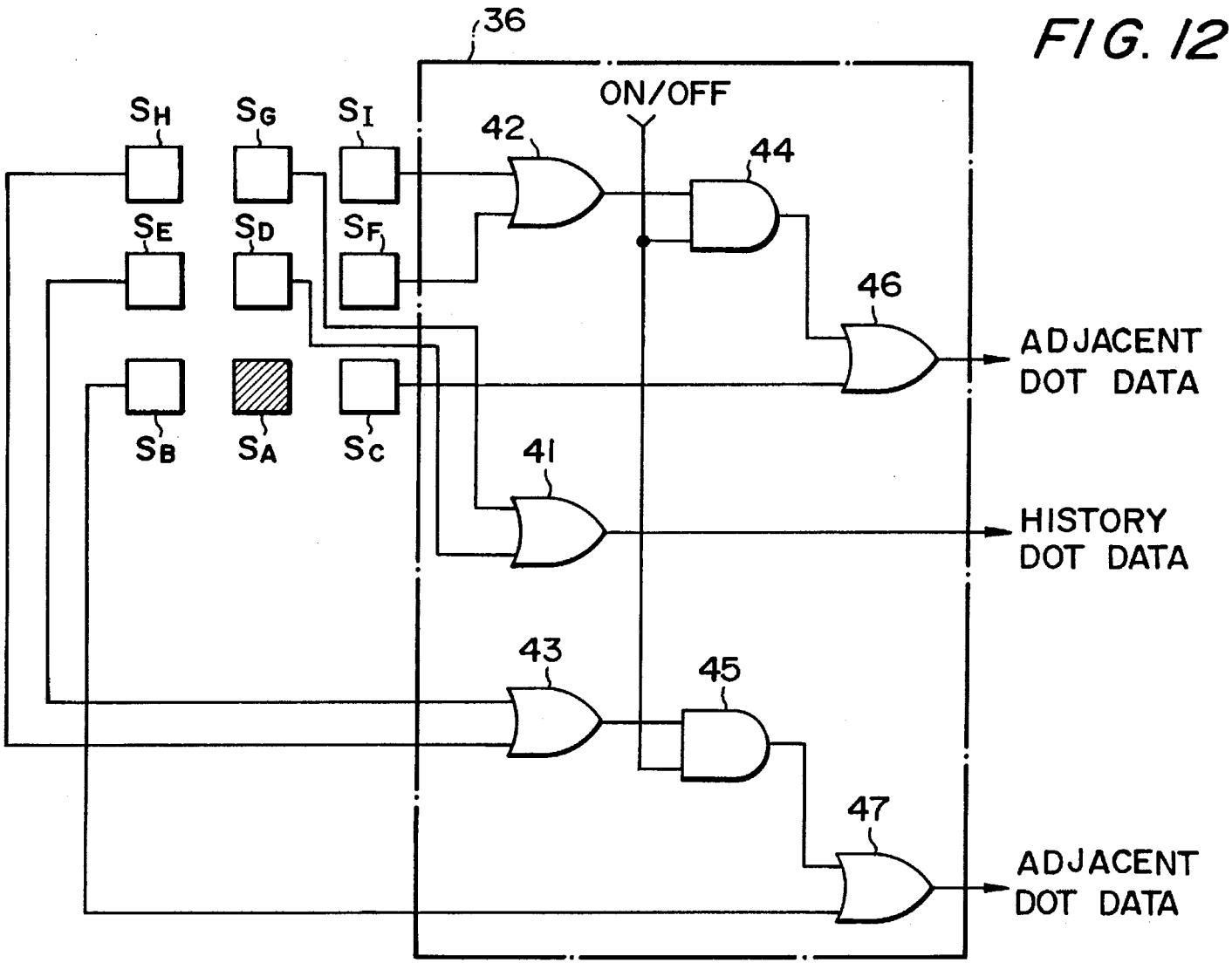
FIG. 12 is a circuit diagram of another embodiment of a history processor shown in FIG. 6.

In FIG. 12, there is shown another embodiment of the history processor 36 shown in FIG. 6 along with the memory cells, having the same construction as the embodiment shown in FIG. 8, except that the outputs of the memory cells $S_D$ and $S_G$ are output as the history dot data of the present heater element through an OR circuit 41. This can be controlled by the outputs of 3 bits, and thus high speed processing can be carried out.

In this embodiment, as shown in FIG. 8, although the three information items (the present time, the preceding time and two times before) of the print information and the print history information of the left and right adjacent heater elements is altogether considered, the print information of the adjacent heater elements and the print history information of the adjacent heater elements can be separately extracted and the history processing of the separated information can take place. Further, although as regards the print history information of the adjacent heater elements, the preceding and two times before information is considered, the history processing can be performed in consideration of only the preceding time information.

As described above, according to the present invention, the history processing is carried out on the basis of not only the print history information of the present heater element but also the print information of the adjacent heater elements and the preceding and two times before print history information of the adjacent heater elements, and hence the printing of the zigzag half pattern or the like can be performed with high quality.

Further, in case of using shift registers, the print information can be readily obtained at a high speed by a simple circuit structure.

Further, in the case where an OR output of the present time print information of the adjacent heater elements and the preceding and two times before print information of the adjacent heater elements is taken, in case that an AND output of an OR output of the preceding time information and the two times before information of the adjacent heater elements and an print speed signal is taken, and then an OR output of this AND output and the present print information of the adjacent heater elements is taken, and an OR output of the preceding time print history information and the two times before print history information of the present heater element is taken, the bit data to be referred to can be reduced, and high speed processing can be carried out by a simple circuit structure.

Furthermore, in particular, in the case where there is provided a switching part for changing ON and OFF the preceding time print information and the two times before print information of the adjacent heater elements, and in the case where an AND output of an OR output of the preceding time information and the two times before information of the adjacent heater elements and a print speed signal is taken, and then an OR output of this AND output and the present print information of the adjacent heater elements is taken, the processing considering the print processing speed can be carried out.

Although the present invention has been described in its preferred embodiments with reference to the accompanying drawings, it it readily understood that the present invention is not restricted to the preferred embodiments and that various changes and modifications can be made by those skilled in the art without departing from the spirit and scope of the present invention.

What is claimed is:

1. A drive control apparatus for a thermal head for carrying out drive control based on print information of a plurality of aligned heater elements, comprising:

a processor means for carrying out processing of print information based only on the following information:

(a) history information of a present heater element to be driven, said history information of said present heater element is information of a preceding and two times before print information of the present heater element;

(b) print information of adjacent heater elements adjacent to the present heater element; and (c) history information of preceding and two times before print information of the adjacent heater elements;

switching means for enabling and disabling processing of the history information of the adjacent heater elements within the processor means based on whether said thermal head is used for low speed printing or high speed printing;

controller means for controlling application energy of the present heater element according to the print information processed by the processor means;

a first shift register for storing present time print information of the heater elements;

a second shift register for storing preceding time print history information of the heater elements;

a third shift register for storing two times before print history information of the heater elements; and a history processor for inputting the print history information of the present heater element to be processed and the print information and the print history information of the adjacent heater elements from the first, second and third shift registers and carrying out a history processing of the present heater element based on the input information.

2. The apparatus of claim 1, wherein the processor means includes an OR circuit for outputting an OR output of present time print information of the adjacent heater elements and the preceding and two times before print information of the adjacent beater elements to process it as the print information of the adjacent heater element.

3. The apparatus of claim 2, wherein the switching means includes a switch part for carrying out an ON and OFF operation of the preceding and two times before print information of the adjacent heater elements.

4. The apparatus of claim 2, wherein the processor means includes an OR circuit for outputting an OR output of the preceding time print history information and two times before print history information of the present heater element to process the print history information of the present heater element.

5. The apparatus of claim 4, wherein the processor means controls current supply time to the present heater element in a priority order of the preceding time print history information of the present heater element, the two times before print history information of the present heater element, and the print information of the adjacent heater elements.

6. The apparatus of claim 1, wherein the processor means includes an AND circuit for outputting an AND output of an OR output of the preceding time print information and the two times before print information of the adjacent heater elements and a printing speed signal, and an OR circuit for outputting an OR output of the AND output of the AND circuit and a present time print information of the adjacent heater elements to process the print information of the adjacent heater elements.

7. The apparatus of claim 6, wherein the processor means includes an OR circuit for outputting an OR output of the preceding time print history information and two times before print history information of the present heater element to process the print history information of the present heater element.

8. The apparatus of claim 6, wherein the processor means controls current supply time to the present heater element in a priority order of the preceding time print history information of the present heater element, two times before print history information of the present heater element, and the print information of the adjacent heater elements.

9. The apparatus of claim 1, wherein said controller means is a first controller means, said apparatus comprising a second controller means for skipping over a priority order, and wherein, when a current supply time to the present heater element is controlled in the priority order of the preceding history print information of the present heater element, the two times before history print information of the present heater element and the print information of the adjacent heater elements, the priority order is skipped over by the second controller means.

10. A drive control apparatus for a thermal head for carrying out drive control based on print information of a plurality of aligned heater elements, comprising:

processor means for carrying out processing of print information based only on the following information:

(a) history information of a present heater element to be driven, said history information of said present heater element is information of a preceding and two times before print information of the present heater element;

(b) print information of adjacent heater elements adjacent to the present heater element; and (c) history information of preceding and two times before print information of the adjacent heater elements;

switching means for enabling and disabling processing of the history information of the adjacent heater elements within the processor means based on whether said thermal head is used for low speed printing or high speed printing; and controller means for controlling application energy of the present heater element according to the print information processed by the processor means, wherein the processor means includes an OR circuit for outputting an OR output of present time print information of the adjacent heater elements and the preceding and two times before print information of the adjacent heater elements to process it as the print information of the adjacent heater element.

11. The apparatus of claim 10, wherein the switching means includes a switch part for carrying out an ON and OFF operation of the preceding and two times before print information of the adjacent heater elements.

12. The apparatus of claim 10, wherein the processor means includes an OR circuit for outputting an OR output of the preceding time print history information and two times before print history information of the present heater element to process the print history information of the present heater element.

13. The apparatus of claim 10, wherein said controller means is a first controller means, said apparatus further comprising second controller means for skipping over a priority order, and wherein, when a current supply time to the present heater element is controlled in the priority order of the preceding history print information of the present heater element, the two times before history print information of the present heater element and the print information of the adjacent heater elements, the priority order is skipped over by the second controller means.

14. A drive control apparatus for a thermal head for carrying out drive control based on print information of a plurality of aligned heater elements, comprising:

processor means for carrying out processing of print information based only on the following information:

(a) history information of a present heater element to be driven, said history information of said present heater element is information of a preceding and two times before print information of the present heater element;

(b) print information of adjacent heater elements adjacent to the present heater element; and (c) history information of preceding and two times before print information of the adjacent heater elements;

switching means for enabling and disabling processing of the history information of the adjacent heater elements within the processor means based on whether said thermal head is used for low speed printing or high speed printing;

controller means for controlling application energy of the present heater element according to the print information processed by the processor means, wherein the processor means includes an OR circuit for outputting an OR output of present time print information of the adjacent heater elements and the preceding and two times before print information of the adjacent heater elements to process it as the print information of the adjacent heater elements; and memory cells for storing print information of the heater elements.

15. The apparatus of claim 14, wherein the switching means includes a switch part for carrying out an ON and OFF operation of the preceding and two times before print information of the adjacent heater elements.

16. A drive control apparatus for a thermal head for carrying out drive control based on print information of a plurality of aligned heater elements, comprising:

processor means for carrying out processing of print information based only on the following information:

(a) history information of a present heater element to be driven, said history information of said present heater element is information of a preceding and two times before print information of the present heater element;

(b) print information of adjacent heater elements adjacent to the present heater element; and (c) history information of preceding and two times before print information of the adjacent heater elements;

switching means for enabling and disabling processing of the history information of the adjacent heater elements within the processor means based on whether said thermal head is used for low speed printing or high speed printing; and controller means for controlling application energy of the present heater element according to the print information processed by the processor means, wherein the processor means includes an AND circuit for outputting an AND output of an OR output of the preceding time print information and the two times before print information of the adjacent heater elements and a printing speed signal, and an OR circuit for outputting an OR output of the AND output from the AND circuit and present time print information of the adjacent heater elements to process the print information of the adjacent heater elements.

17. The apparatus of claim 16, wherein the processor means controls current supply time to the present heater element in a priority order of the preceding time print history information of the present heater element, the two times before print history information of the present heater element, and the print information of the adjacent heater elements.

18. A drive control apparatus for a thermal head for carrying out drive control based on print information of a plurality of aligned heater elements, comprising:

processor means for carrying out processing of print information based only on the following information:

(a) history information of a present heater element to be driven, said history information of said present heater element is information of a preceding and two times before print information of the present heater element;

(b) print information of adjacent heater elements adjacent to the present heater element; and (c) history information of preceding and two times before print information of the adjacent heater elements;

switching means for enabling and disabling processing of the history information of the adjacent heater elements within the processor means based on whether said thermal head is used for low speed printing or high speed printing;

controller means for controlling application energy of the present heater element according to the print information processed by the processor means, wherein the processor means includes an AND circuit for outputting an AND output of an OR output of the preceding time print information and the two times before print information of the adjacent heater elements and a printing speed signal, and an OR circuit for outputting an OR output of the AND output of the AND circuit and present time printing information of the adjacent heater elements to process the print information of the adjacent heater elements; and memory cells for storing print information of the heater elements.

19. The apparatus of claim 18, wherein the processor means includes an OR circuit for outputting an OR output of the preceding time print history information and two times before print history information of the present heater element to process the print history information of the present heater element.

20. A drive control apparatus for a thermal head for carrying out drive control based on print information of a plurality of aligned heater elements, comprising:

processor means for carrying out processing of print information based only on the following information:

(a) history information of a present heater element to be driven, said history information of said present heater element is information of a preceding and two times before print information of the present heater element;

(b) print information of adjacent heater elements adjacent to the present heater element; and (c) history information of preceding and two times before print information of the adjacent heater elements;

switching means for enabling and disabling processing of the history information of the adjacent heater elements within the processor means based on whether said thermal head is used for low speed printing or high speed printing; and controller means for controlling application energy of the present heater element according to the print information processed by the processor means, wherein the processor means includes an OR circuit for outputting an OR output of the preceding and two times before print information of the present heater element to process the print history information of the present heater element.

* * * * *